United States Patent [19]

Carrieri

[11] 4,370,878

[45] Feb. 1, 1983

[54] WORKPIECE EJECTOR SYSTEM FOR PRESSES

[75] Inventor: Louis F. Carrieri, LaGrange Park, Ill.

[73] Assignee: Gulf & Western Manufacturing Company, Southfield, Mich.

[21] Appl. No.: 232,733

[22] Filed: Feb. 9, 1981

[51] Int. Cl.[3] ..... B21D 45/04

[52] U.S. Cl. ..... 72/345; 72/427

[58] Field of Search ..... 72/345, 346, 427; 100/218; 83/125, 128

[56] References Cited

U.S. PATENT DOCUMENTS

| | | | |
|---|---|---|---|
| 2,159,901 | 5/1939 | Le Jeune | 72/345 |
| 2,280,849 | 4/1942 | Pocock | 100/71 |
| 2,379,002 | 6/1945 | Haller | 83/229 |
| 2,490,954 | 12/1949 | Flick | 72/345 |
| 2,586,536 | 2/1952 | Haller | 72/421 |
| 3,157,111 | 11/1964 | Andersen | 100/218 |
| 3,411,340 | 11/1968 | Asari | 72/427 |
| 3,456,465 | 7/1969 | Pax et al. | 72/421 |
| 3,998,087 | 12/1976 | Schumacher et al. | 72/405 |
| 4,068,520 | 1/1978 | Carrieri | 72/427 |

*Primary Examiner*—Lowell A. Larson
*Attorney, Agent, or Firm*—Meyer, Tilberry & Body

[57] ABSTRACT

An improved workpiece ejecting system for presses includes an ejector piston hydraulically driven in response to reciprocation of the press slide in a manner whereby the motion of displacement of the ejector piston corresponds to the motion of displacement of the press slide during the stroke thereof, and the extent of displacement and velocity of the ejector piston are proportional to the corresponding characteristics of the slide. Ejector piston displacement is achieved by the flow of hydraulic fluid to and from the ejector piston chamber during reciprocation of the press slide through its total stroke. Ejector pins of various lengths are selectively associated with the press tooling and ejector piston to provide for varying the length of the workpiece ejecting stroke. Displacement of the ejector piston in the ejecting direction can be stopped prior to the slide reaching the end of its return stroke to provide a dwell in ejector pin displacement to facilitate workpiece feeding and removal with respect to the press tooling.

25 Claims, 3 Drawing Figures

WORKPIECE EJECTOR SYSTEM FOR PRESSES

BACKGROUND OF THE INVENTION

The present invention relates to the art of workpiece ejectors for presses and, more particularly, to an improved mechanical-hydraulic ejector system for presses.

It is of course well known to provide presses with workpiece ejectors operable to separate a workpiece from press tooling following the forming or other work performed on the workpiece while interposed between the tooling. Among the ejector systems heretofore provided for this purpose are mechanical-hydraulic arrangements such as that shown in my U.S. Pat. No. 4,068,520 wherein a workpiece ejecting member is hydraulically displaced in an ejecting direction during return movement of a press slide by means of hydraulic pistons which are actuated by cams carried by the press slide. The use of cams displaced by the press slide for actuating the hydraulic pistons advantageously enables achieving displacement of the ejector member with desired acceleration and deceleration characteristics. However, such an ejector arrangement requires accurate machining of the cams for this purpose, and accurate positioning of the cams relative to the hydraulic pistons to achieve the desired length of the ejector member stroke and timing thereof with respect to slide movement. Accordingly, the arrangement is undesirably expensive to manufacture and incorporate in the press structure and, additionally, requires adjustment of the cam members relative to the hydraulic pistons each time the press shut height is adjusted. The latter requirement results in considerable down time and maintenance costs in connection with such shut height adjusting. Moreover, cams having different profiles are required in order to vary the ejector stroke length to enable the use of different tooling sets with the press. This requirement increases costs with respect to the ejector mechanism or, if different cams are not provided, limits versatility of the ejector mechanism and thus use of the press to tooling which the ejector mechanism can properly function.

Another mechanical-hydraulic ejector arrangement heretofore provided is disclosed in U.S. Pat. No. 3,157,111 to Andersen. In the arrangement disclosed in the latter patent, the displacement of hydraulic fluid relative to an ejecting piston is achieved by means of a piston and cylinder assembly connected between the press slide and frame. The cylinder provides a fluid chamber into and from which hydraulic fluid is displaced in response to reciprocation of the press slide, and the flow of fluid between the chamber and the ejector piston and a fluid reservoir is controlled by a shutoff valve and a pressure regulating valve, both of which are cam actuated in response to reciprocation of the slide relative to the press frame. The shutoff valve provides for fluid flow to the ejector piston during a short period of the return stroke of the slide, and the pressure regulating valve provides for such fluid flow to be at a constant pressure. Ejector systems of this character are undesirably expensive as a result of the cams, valves and complex flow line arrangements required to achieve the desired patterns of fluid flow. Further, the cam for the shutoff valve must be adjusted each time the slide shut height is changed and must be adjusted to obtain and maintain the desired timing of the ejector actuation. These adjustment requirements result in increased down time and maintenance costs with respect to press operation. Still further, the control of fluid flow by a shutoff valve and pressure regulating valve result in flow characteristics in the system which generate undesirably high temperatures, sudden pressures and flow direction changes which are detrimental to the component parts of the system, and the sudden and high velocity displacement of the ejector piston to the ejecting position thereof. Such displacement of the ejector piston can result in propelling a workpiece from the tooling as opposed to merely achieving release of the workpiece from the tooling.

SUMMARY OF THE INVENTION

The present invention relates to a mechanical-hydraulic workpiece ejector system for a press which minimizes or overcomes the disadvantages of such systems heretofore provided, including those in the systems referred to hereinabove. More particularly, in this respect, the invention provides an ejector system in which a hydraulic fluid operated ejector actuator is in continuous and unobstructed flow communication with a variable volume fluid chamber relative to which hydraulic fluid is continuously displaced during reciprocation of the press slide through its total stroke. Such flow communication provides for displacement of the ejector actuator in the direction of workpiece ejection to begin simultaneously with the beginning of the return stroke of the slide, and provides for the actuator to have a motion of displacement corresponding to the motion of displacement of the slide as the latter moves toward the end of its return stroke. Thus, for example, if the slide is driven by a slider-crank drive mechanism which provides a sinusoidal motion characteristic for the slide, the ejector actuator is displaced with a corresponding motion characteristic. Such flow communication also provides for the ejector actuator to be displaced in the ejecting direction a distance and at a velocity proportional to the corresponding characteristics of the slide displacement. The fluid flow relationship between the variable volume chamber and ejector actuator advantageously provides fluid flow characteristics in the system which minimize heat generation and wear of the component parts in the system. Moreover, the ejector system according to the present invention advantageously eliminates costly cams and valves and minimizes flow line requirements, thus to reduce both production and maintenance costs and down time for maintenance or replacement of such component parts. Still further, and importantly, the arrangement according to the present invention is uneffected by changes in shut height of the press slide, thus eliminating down time for component part adjustment to achieve desired ejector operation following a shut height adjustment.

In accordance with one aspect of the present invention, displacement of the ejector actuator in the ejecting direction is stopped prior to the press slide reaching the end of its return stroke, thus to provide a dwell in the ejector displacement to facilitate the introduction and removal of workpieces relative to the tooling in the press. In accordance with another aspect of the invention, the ejector actuator displaces a workpiece ejector member, such as an ejector pin for example, and which ejector member is separate from the actuator and removably supported relative thereto and to the press tooling. The ejector actuator is displaceable between extended and retracted positions defining an ejector actuator stroke, and the removable and replaceable ejector member enables the use of ejector members having different lengths to achieve different ejector member stroke lengths in connection with the stroke length of the actuator. Accordingly, a press having the ejector system incorporated therewith can be used with different tooling arrangements requiring different workpiece ejecting stroke lengths.

It is accordingly an outstanding object of the present invention to provide an improved mechanical-hydraulic workpiece ejector system for presses.

Another object is the provision of an ejection system of the foregoing character including a hydraulically displaced ejector actuator which is displaced in the direction of ejection with a motion characteristic corresponding to that of the press slide and with stroke length and velocity characteristics proportional to those of the slide.

Yet another object is the provision of an ejector system of the foregoing character in which the operation of the system is uneffected by slide shut height adjustment.

A further object is the provision of an ejector system of the foregoing character which provides improved ejector displacement of a workpiece from press tooling.

Yet a further object is the provision of an ejector system of the foregoing character which promotes versatility with respect to use thereof with press tooling requiring different ejector stroke lengths for achieving workpiece ejection.

Yet another object is the provision of an ejector system of the foregoing character which provides a dwell at the end of workpiece ejection to facilitate introduction and removal of workpieces from the press tooling.

Still another object is the provision of an ejector system of the foregoing character which is structurally simple, efficient in operation, and economical to produce and maintain.

BRIEF DESCRIPTION OF THE DRAWINGS

The foregoing objects, and others, will in part be obvious and in part pointed out more fully hereinafter in conjunction with the written description of a preferred embodiment of the invention illustrated in the accompanying drawing in which.

DESCRIPTION OF A PREFERRED EMBODIMENT

Figure 1:
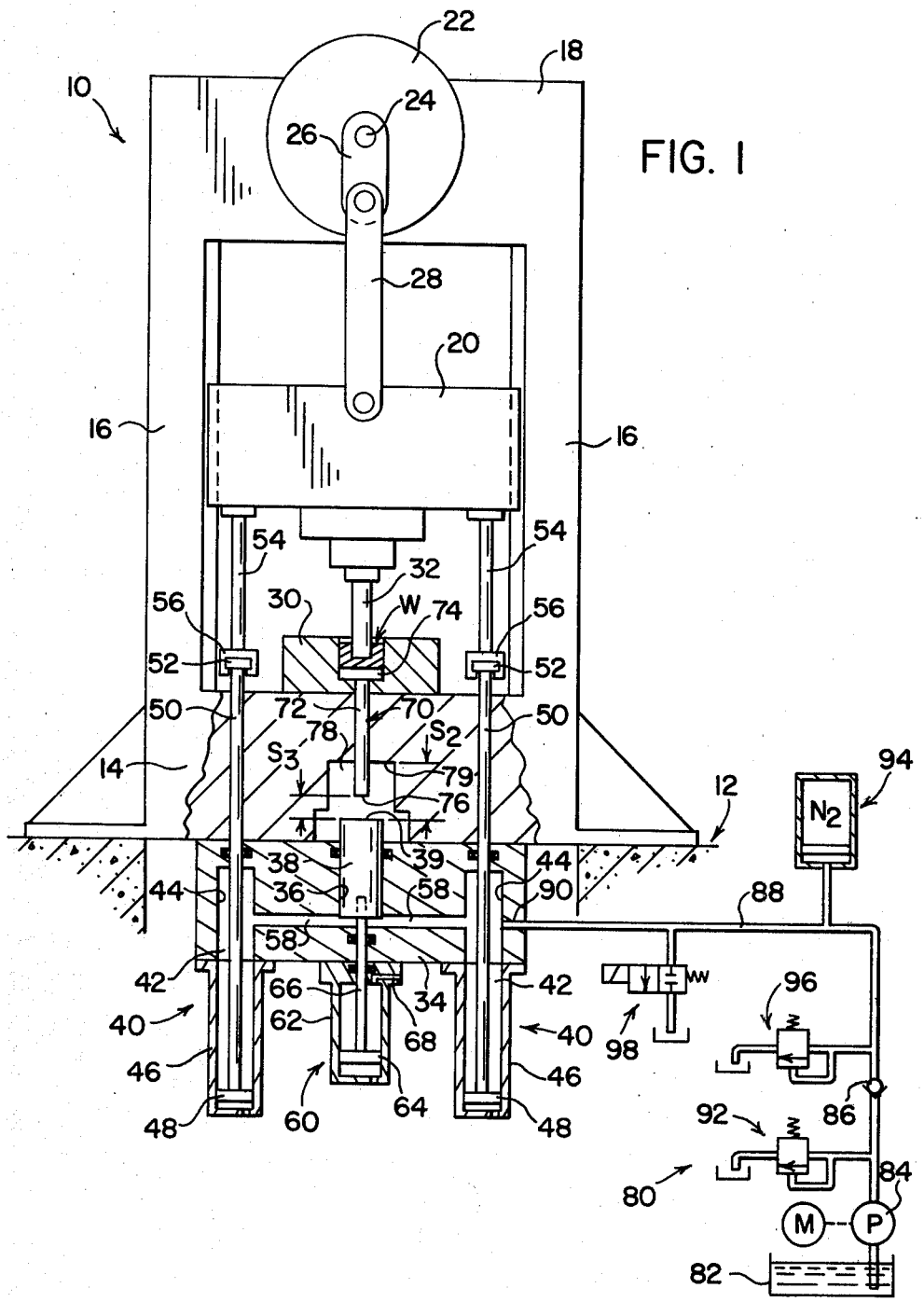
FIG. 1 is a front elevation view, partially in section, and somewhat schematically illustrating a press provided with a workpiece ejector system according to the present invention, and showing the component parts of the press and ejector system in the positions thereof just prior to an ejecting operation.
Figure 2:
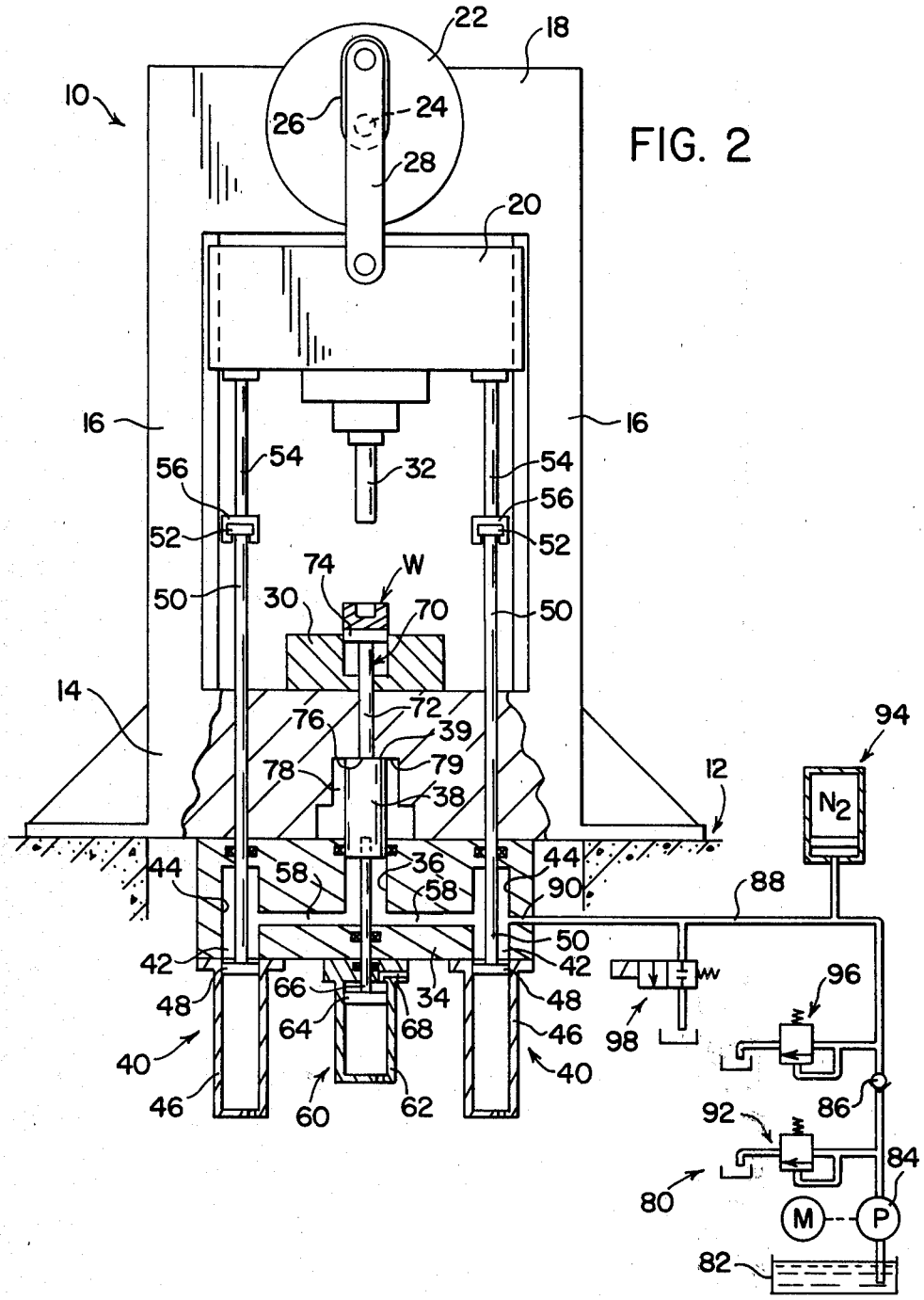
FIG. 2 is a view similar to FIG. 1 and illustrating the component parts of the press and ejector system in the positions thereof following workpiece ejection; and, FIG. 3 is a graph showing the motion characteristics of the press slide and ejector piston during the strokes thereof.

Referring now in greater detail to the drawings wherein the showings are for the purpose of illustrating a preferred embodiment of the invention only and not for the purpose of limiting the invention, FIGS. 1 and 2 illustrate a press 10 mounted on a supporting structure 12 such as a floor and comprising a frame providing a press bed 14, uprights 16 and a crown portion 18. The press further includes a vertically reciprocable slide 20 which, in the embodiment illustrated, is driven by a common slider-crank type drive mechanism in crown portion 18. As is well known, such a drive mechanism basically includes a motor driven flywheel 22 for rotating a drive shaft 24 having a crankarm 26, and a connecting rod 28 having one end pivotally interconnected with crankarm 26 and the other end pivotally interconnected with slide 20, whereby rotation of flywheel 22 reciprocates slide 20 through a total stroke including advance and return strokes with respect to press bed 14. FIGS. 1 and 2 of the drawing respectively show the slide at the ends of the advance and return strokes. The press bed and slide are provided with tooling cooperable during the advance stroke of the slide to perform work on a workpiece interposed therebetween and which tooling, in the embodiment illustrated, is provided by a forging die 30 suitably supported on press bed 14 and a forging punch 32 mounted on slide 20 for reciprocation therewith. As will be appreciated from FIG. 1, the forging die and punch cooperably interengage during movement of slide 20 toward press bed 14 to shape a workpiece W which is positioned therebetween while the slide is in a retracted position relative to the press bed.

In accordance with the present invention, press 10 is provided with a workpiece ejector system operable to eject workpiece W from die 30 following the forming operation and during upward displacement of slide 20 through its return stroke. More particularly in this respect, a supporting member 34 is mounted on the underside of press bed 14 and is provided with a hydraulic fluid receiving chamber 36 which is open at its upper end and closed at its lower end. Chamber 36 reciprocably supports an ejector actuating piston 38 which is adapted to be hydraulically displaced upwardly in chamber 36, in an ejecting direction with respect to die 30, by fluid flow from fluid displacing mechanisms 40 which are driven by press slide 20. In the embodiment illustrated, each of the fluid displacing mechanisms 40 includes a variable volume fluid receiving chamber 42 defined in part by a corresponding recess 44 in support member 34 and in part by a corresponding cylinder member 46 suitably attached to the support member. Each mechanism 40 further includes a piston 48 reciprocable within the corresponding chamber 42 to vary the volume of the chamber. Each piston 48 is adapted to be reciprocated by and with slide 20 by means of a corresponding piston rod 50 extending upwardly through press bed 14 and having a headed upper end 52 coupled with a corresponding pull rod 54. Each pull rod has an upper end attached to slide 20 and a lower end provided with a coupling collar 56 which axially interengages with the corresponding piston rod head 52 to prevent relative axial displacement therebetween while allowing relative lateral displacement. Such lateral displacement provides compensation for adjustment of the slide gibbing which would laterally shift slide 20 and pull rods 54 relative to piston rods 50.

Fluid receiving chambers 42 are in continuously open fluid flow communication with the lower end of chamber 37 beneath ejector actuating piston 38 by means of a corresponding flow line 58. In the positions of the component parts shown in FIG. 1 of the drawing, ejector actuating piston 38 is in the retracted position thereof, and the piston is biased toward the latter position by means of a pneumatic piston and cylinder assembly 60. The latter assembly includes a cylinder 62 mounted on support member 34 and reciprocably supporting a piston 64 having a piston rod 66 extending upwardly through cylinder 62 and having an upper end threadedly or otherwise interengaged with piston 38. Cylinder 62 receives air under pressure from a suitable source, not shown, through an inlet passageway 68 above piston 64, whereby piston 64 is biased downwardly to bias ejector actuator piston 38 in the direction of retraction thereof. While a pneumatic bias is preferred, it will be appreciated that such biasing of the ejector actuator piston could be equally well achieved by means of a biasing spring. Moreover, it will be appreciated that fluid displacing mechanisms 40 and the piston-cylinder assembly defined by chamber 36 and piston 38 could each be a double acting piston-cylinder arrangement with flow communication therebetween on opposite sides of the piston components. This would provide for reciprocation of the ejector actuator piston in opposite directions by fluid flow from the fluid displacing mechanisms without a biasing arrangement of the foregoing character for the ejector actuator piston.

In the preferred embodiment, and for the purpose set forth more fully hereinafter, workpiece W is adapted to be ejected from die 30 by means of an ejector member 70 which is separate from ejector actuator piston 38 and is removably supported relative to the press bed and die 30. In the embodiment illustrated, ejector member 70 is a free floating ejector pin having a shank portion 72 extending downwardly through corresponding openings therefor in die 30 and press bed 14 and having a headed upper end 74 engaging the bottom of the cavity in die 30 so as to axially position the pin relative to piston 38. Shank portion 72 has an inner end 76 disposed in a cavity 78 in the underside of press bed 14 so as to be engaged by upper end face 39 of piston 38 during movement of piston 38 in the ejection direction. Cavity 78 receives the upper end of piston 38 during upward displacement thereof and has an upper end wall 79 which serves a purpose set forth hereinafter.

Hydraulic fluid for the ejector system is supplied to chambers 42, flow lines 58 and the lower end of chamber 36 by a hydraulic fluid supply circuit 80 and at a pressure below the biasing force of piston-cylinder unit 60. Any suitable hydraulic supply circuit can be provided for this purpose and, in the embodiment illustrated, supply circuit 80 includes a hydraulic fluid supply reservoir 82, a motor driven pump 84 operable to deliver hydraulic fluid from source 82 to the system through a one way check valve 86, which prevents back flow to source 82, and thence through a flow line 88 connected to an inlet passageway 90 in support member 34. Inlet passageway 90 communicates with one of the chambers 42 and thus flow lines 58, chamber 36 and the other chamber 42. Once the system is initially filled with hydraulic fluid, pump 84 operates merely as a replenishing pump intended only to make up leakage in the system. A low pressure relief valve 92 is connected between pump 84 and valve 86 and is set at a pressure below the biasing force of piston-cylinder unit 60, thus to prevent fluid pressure in chamber 36 reaching a level which would overcome the bias of unit 60 and causes unintended displacement of ejector actuating piston 38 in the ejecting direction. For the purpose set forth hereinafter, a nitrogen charged high pressure accumulator 94 is connected in the supply circuit between valve 86 and inlet passageway 90. Further, a high pressure relief valve 96 is provided between valve 86 and passageway 90 to provide overload protection for the press and ejector system. The hydraulic supply system further includes a solenoid operated two-way valve 98 in flow line 88 which enables operator release of fluid from the ejector system for the purpose set forth hereinafter.

With regard to the operation of the ejector system, it will be appreciated from the positions of the component parts illustrated in FIG. 1 of the drawing that press slide 20 is at the end of its advance stroke, whereby work has been performed on workpiece W by tooling 30 and 32. Ejector actuator piston 38 is in its retracted position and, in the latter position, upper end face 39 of the piston is spaced from end wall 79 of recess 78 a distance S2 and is spaced from lower end 76 of ejector pin 70 a distance S3. The significance of the latter dimensions is set forth hereinafter. As slide 20 begins to move upwardly through its return stroke, pull rods 54 and piston rods 50 displace pistons 48 upwardly in chambers 42, whereby hydraulic fluid is immediately displaced from chambers 42 directly to the lower end of chamber 36 through feed lines 58 to displace ejector actuator piston 38 upwardly in the ejecting direction toward ejector pin 70. During continued upward movement of slide 20 upper end face 39 of ejector actuator piston 38 engages lower end 76 of ejector pin 70 to displace the latter upwardly to eject workpiece W from the cavity of die 30.

As slide 20 approaches the upper end of its return stroke, which upper end position is illustrated in FIG. 2 of the drawing, upper end face 39 of piston 38 engages end wall 79 of cavity 78. This engagement stops displacement of the ejector actuator piston in the ejecting direction, and thus pin 70, after the piston has traveled the distance S2 which represents the ejecting stroke of the ejector actuator piston. In the preferred embodiment, and as explained more fully hereinafter, end face 39 engages end wall 79 prior to slide 20 reaching the end of its return stroke, thus providing a dwell in the displacement of ejector pin 70 to facilitate workpiece removal and replacement. During the continued upward movement of slide 20 after engagement of end face 39 with wall 79, hydraulic fluid in chambers 42 is displaced through passageway 90 and is received in high pressure accumulator 94. After slide 20 reaches the end of its return stroke and begins to move downwardly through its advance stroke, pull rods 54 and piston rods 50 displace pistons 48 downwardly in chambers 42, thus to progressively increase the volumes thereof, and during initial downward movement of slide 20 the hydraulic fluid in high pressure accumulator 94 flows into chambers 42 through flow line 88 and passageway 90. After such initial downward movement of the slide 20, the bias of piston-cylinder unit 60 and the downward movement of pistons 48 in chambers 42 causes the hydraulic fluid in chamber 36 to flow through flow lines 58 into chambers 42, whereby ejector actuator piston 38 moves downward in chamber 36. When slide 20 reaches the bottom of its advance stroke, the component parts are again positioned as shown in FIG. 1 in readiness for the next ejecting operation. It will be appreciated of course that the length of the displacement of ejector actuator piston 38 will be less than the length of the return stroke of the slide to provide the necessary clearance for removing and inserting workpieces between the press tooling, and it will be further appreciated that the cross-sectional dimensions of chambers 42 and 36 are proportioned for fluid flow from chambers 42 to chamber 36 to provide the desired ejector actuator piston displacement relative to the length of the return stroke of the slide. The proportional relationship between the strokes of slide 20 and ejector actuator piston 38 will vary depending on several factors including the tooling and the character of work being performed thereby and, generally, the slide to piston displacement ratio will be between 2:1 to 4:1.

As mentioned hereinabove, ejector pin 70 is removable and replaceable, thus enabling the use of ejector pins of different lengths in the ejector system to provide for ejector pin strokes of different lengths relative to the press tooling. It will be appreciated from the foregoing description that the ejector actuator piston stroke S2 is fixed and that the stroke of the ejector pin 70 is equal to the differences between S2 and S3. Accordingly, by varying the length of the ejector pin so as to provide for the distance S3 to be between 0 and the length S2, the stroke of ejector pin 70 can be varied between 0 and the distance S2.

In the event of an overload on the ejector system during an ejector operation, such as would occur by failure of the ejector piston to be displaced upwardly in response to upward movement of slide 20, high pressure relief valve 96 will open in response to such overload for the fluid in chambers 36 and 42 to flow back to fluid source 82. Solenoid operated two-way valve 98 provides for operator controlled release of hydraulic fluid from chambers 36 and 42 whenever it is desired to achieve such release. For example, a failure in biasing assembly 60 following an ejecting operation would cause a reduction in system pressure below the bias of relief valve 92, whereby pump 84 would pump fluid into the system past valve 86 which would cause ejector actuator piston 38 to remain in the extended position thereof. Valve 98 provides for relieving the low pressure fluid in the system in such a case to enable retraction of the ejector actuator piston.

Figure 3:
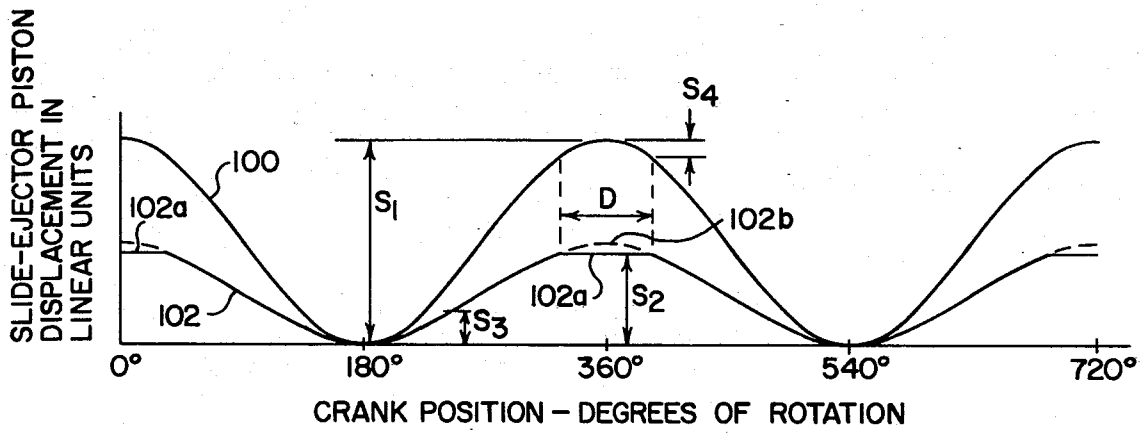

As mentioned hereinabove, and as will be appreciated from FIG. 3 of the drawing, the continuously open fluid flow communication between chambers 42 of fluid displacing mechanisms 40 and chamber 36 of ejector actuator piston 38 advantageously provides for the ejector piston to be displaced with a motion characteristic corresponding to that of slide 20 and at a velocity and stroke or length of displacement proportional to the slide velocity and stroke length. With regard to FIG. 3, curve 100 represents the motion of slide 20 during each cycle of rotation of the press crankshaft 360° and, as is well known, a slider-crank type drive of the character illustrated in FIGS. 1 and 2 provides for such motion to be a harmonic, sinusoidal motion. In the illustrated embodiment, slide 20 moves through the advance stroke through the first 180° of crank rotation from the crank position shown in FIG. 2 to the position shown in FIG. 1, and thence through the return stroke during the next 180° of crank rotation back to the crank position shown in FIG. 2. The vertical extent of curve 100 represents the length of slide displacement, designated S1, and the incline of curve 100 relative to horizontal between 0 and 180° of crank rotation and between 180° and 360° of crank rotation is respectively representative of the slide velocity during the advance and return strokes thereof. Curve 102 in FIG. 3 represents the corresponding motion, displacement and velocity characteristics of ejector actuator piston 38 during the advance and return strokes of the slide. It will be seen from curve 102 that the ejector actuator piston motion follows the harmonic, sinusoidal motion of the slide, except for portions 102*a* wherein the motion of the ejector actuator piston is modified by engagement of end face 39 thereof with end wall 79 of recess 78 in the press bed to achieve a dwell in the ejector pin movement as described hereinabove. While such a dwell is desirable, it will be appreciated that recess wall 79 could be spaced from end face 39 of the ejector piston a distance which would prevent such engagement therebetween. Accordingly, the ejector actuator piston would then continuously move with the slide, and would have the motion characteristics at the extended end of the movement in the direction of ejection indicated by broken line 102*b* in FIG. 3, thus to have a harmonic, sinusoidal motion characteristic throughout its stroke.

As with curve 100 representing the slide characteristics, the vertical extent of curve 102 is representative of the length of ejector actuator piston displacement between the retracted and extended positions, whereby dimensions S2 and S3 in the graph correspond to the dimensional representations S2 and S3 in FIG. 1 of the drawing. Likewise, the incline of curve 102 relative to horizontal between the 0° and 180° extent of crank rotation and between 180° and 360° extent thereof are representative of the velocity of the ejector actuator piston respectively during the retraction and extension strokes thereof. As will be appreciated from a comparison of curves 100 and 102 and from the description hereinabove of the proportional dimensional relationships between chambers 42 and chamber 36, the displacement stroke of the ejector actuator piston and the velocity of displacement thereof are proportionately smaller than the corresponding displacement and velocity of the slide. It will be further appreciated from FIG. 3, in connection with the description of the operation of the system hereinabove, that the ejector actuator piston begins to move from the retracted toward the extended position thereof in the direction of ejection when the slide begins to move through the return stroke thereof, that the ejector actuator piston moves in the direction of ejection the distance S3 before engaging the ejector pin, and then engages wall 79 in cavity 78 after moving the distance S2 and before the slide reaches the end of its return stroke, as designated by displacement distance S4 in FIG. 3. The ejector piston is stopped by wall 79 and remains in the extended position represented by distance S2 as the slide completes its return stroke and until the slide moves through its advance stroke the distance S4, whereupon the ejector piston moves in the direction of retraction with the slide. The distance S4 provides a dwell time D, and it will be appreciated that the extent of the dwell time in terms of crank rotation can be varied by increasing or decreasing the distance S2 from that represented in the graph.

While considerable emphasis has been placed herein on the preferred embodiment, it will be appreciated that other embodiments can readily be devised and that the preferred embodiment can be readily modified without departing from the principles of the present invention. In this respect, for example, it will be appreciated that the slide can be driven by a modified slider-crank drive, or by other mechanical drive arrangements, and that the slide actuation of the fluid displacing mechanisms and the continuously open flow communication between the latter and the ejector actuating piston will provide for the latter to be displaced with a motion characteristic corresponding to that of the slide during reciprocation thereof by the drive arrangement. Moreover, while the ejector actuator is preferably defined by a fixed cylinder and displaceable piston, the latter arrangement could be reversed, or other variable volume chamber arrangements could be devised to be responsive to fluid flow from the fluid flow displacing mechanisms. With regard to the latter mechanisms, the fixed chamber and displaceable piston arrangements thereof could be reversed, or other variable volume chamber arrangements devised to achieve the desired fluid displacement in response to slide reciprocation. It will be appreciated too that the ejector components could be structurally associated with the press slide as opposed to the press bed for ejection of a workpiece from tooling on the slide during return movement thereof. These and other modifications of the preferred embodiment, as well as other embodiments of the present invention, will be suggested or obvious to those skilled in the art and, therefore, it is to be distinctly understood that the foregoing descriptive matter is to be interpreted as illustrative of the present invention and not as a limitation.

Having thus described the invention, it is claimed:

1. A hydraulic workpiece ejector system for a press having frame means supporting first tool means, slide means reciprocable through a slide stroke between first and second slide positions relative to said first tool means, said slide means carrying second tool means cooperable with said first tool means in said first slide position to perform work on a workpiece interposed therebetween, and means to reciprocate said slide means, said ejector system including ejector means associated with one of said first and second tool means and including hydraulic fluid operated ejector actuating means, relatively displaceable means including hydraulic fluid chamber means and means to vary the volume of said chamber means, said relatively displaceable means being connected between said frame means and slide means to continuously vary the volume of said chamber means in response to reciprocation of said slide means and throughout said slide stroke, and continuously open flow line means connecting said chamber means with said ejector actuating means, whereby said actuating means is displaced in an ejecting direction relative to said one tooling means during movement of said slide means from said first toward said second slide position and with a motion of displacement corresponding to the motion of displacement of said slide means.

2. The workpiece ejector system according to claim 1, wherein said relatively displaceable means provides for the velocity and extent of displacement of said ejector actuating means in said ejecting direction to be proportional to and lower than the velocity and extent of displacement of said slide means.

3. A workpiece ejector system according to claim 1, and means to stop displacement of said ejector means in said ejecting direction before said slide means reaches said second position.

4. A workpiece ejector system according to claim 1, wherein said ejector means includes an ejector member removably supported relative to said one tool means and displaced in said ejecting direction by said ejector actuating means to eject a workpiece from said one tool means.

5. A workpiece ejector system according to claim 1, wherein said ejector actuating means has extended and retracted positions relative to said one tool means, said ejecting direction being from said retracted toward said extended position, and means biasing said ejector actuating means toward said retracted position.

6. A workpiece ejector system according to claim 5, and means to stop displacement of said ejector means in said ejecting direction before said slide means reaches said second position.

7. A workpiece ejector system according to claim 5, wherein said ejector means includes an ejector member removably supported relative to said one tool means and displaced in said ejecting direction by said ejector actuating means to eject a workpiece from said one tool means, said ejector member having an end engaged by said actuating means during displacement of said actuating means from said retracted position toward said extended position, and said end being spaced from said actuating means in said ejecting direction when said actuating means is in said retracted position.

8. A workpiece ejector system according to claim 7, and means to stop displacement of said ejector means in said ejecting direction before said slide means reaches said second position.

9. A workpiece ejector system according to claim 1, wherein said one tool means is on said frame means, said ejector actuating means including ejector chamber means on said frame means and ejector piston means in said ejector chamber means and reciprocable relative thereto between extended and retracted positions, said ejecting direction being from said retracted toward said extended position, and means biasing said ejector piston means toward said retracted position.

10. A workpiece ejector system according to claim 9, wherein said ejector piston means has an outer end with respect to said ejecting direction, and said frame means includes abutment means spaced from said outer end and engaged thereby during movement of said piston means in said ejecting direction to stop said piston means in said extended position.

11. A workpiece ejector system according to claim 10, wherein said outer end of said piston means engages said abutment means before said slide means reaches said second position, and fluid pressure relief means in flow communication with said chamber means and flow line means to release fluid under pressure therein following engagement of said piston means with said abutment means.

12. A workpiece ejector system according to claim 11, wherein said relief means includes fluid pressure responsive accumulator means.

13. A workpiece ejector system according to claim 9, wherein said ejector means further includes an ejector member separate from said ejector piston means and removably supported relative to said one tool means, said ejector member being engaged by said piston means and displaced in said ejecting direction during movement of said piston means from said retracted to said extended position.

14. A workpiece ejecting system according to claim 13, wherein said ejector piston means has an outer end and said ejector member has an inner end facing said outer end and spaced therefrom in said ejecting direction when said piston means is in said retracted position.

15. A workpiece ejecting system according to claim 14, wherein said frame means includes abutment means spaced from said outer end of said piston means in said ejecting direction and engaged by said outer end during movement of said piston means in said ejecting direction to stop said piston means in said extended position, said outer end in said retracted position of said piston means being closer to said inner end of said ejector member than to said abutment means.

16. A workpiece ejecting system according to claim 15, wherein said outer end of said piston means engages said abutment means before said slide means reaches said second position, and fluid pressure relief means in flow communication with said chamber means and flow line means to release fluid under pressure therein following engagement of said piston means with said abutment means.

17. A workpiece ejecting system according to claim 16, wherein said hydraulic fluid chamber means includes fixed cylinder means on one of said frame means and slide means, and said means to vary the volume of said chamber means includes piston member means in said fixed cylinder means and piston rod means connected to said piston member means and to the other of said frame means and slide means.

18. A hydraulic workpiece ejector system for a press having frame means including bed means supporting first tool means, slide means reciprocable through a slide stroke between first and second slide positions relative to said first tool means, said slide means carrying second tool means cooperable with said first tool means in said first slide position to perform work on a workpiece interposed therebetween, and means to reciprocate said slide means, said ejector system including ejector means associated with said first tool means and including ejector chamber means supported by said bed means and ejector piston means in said ejector chamber means, hydraulic fluid receiving chamber means supported on said bed means, fluid displacing piston means in said receiving chamber means and connected to said slide means to continuously vary the volume of said receiving chamber means in response to reciprocation of said slide means and throughout said slide stroke, and continuously open flow line means connecting said fluid receiving chamber means with said ejector means, whereby said ejector piston means is displaced in an ejecting direction relative to said one tooling means during movement of said slide means from said first toward said second slide position and with a motion of displacement corresponding to the motion of displacement of said slide means.

19. A workpiece ejector system according to claim 18, wherein said ejector chamber means includes means to stop displacement of said ejector piston means in said ejecting direction before said slide means reaches said second position.

20. A workpiece ejector system according to claim 18, wherein said ejector means includes an ejector member removably supported relative to said one tool means and displaced in said ejecting direction by said ejector piston means to eject a workpiece from said one tool means.

21. A workpiece ejector system according to claim 20, wherein said ejector piston means has extended and retracted positions relative to said one tool means, said ejecting direction being from said retracted toward said extended position, said ejector member having an end engaged by said ejector piston means during displacement of said ejector piston means in said ejecting direction, and said end being spaced from said ejector piston means in said ejecting direction when said ejector piston means is in said retracted position.

22. A workpiece ejector system according to claim 21, and means biasing said ejector piston means toward said retracted piston.

23. A workpiece ejector system according to claim 22, wherein said ejector piston means has an outer end with respect to said ejecting direction, and said ejector chamber means includes abutment means spaced from said outer end and engaged thereby during movement of said ejector piston means in said ejecting direction to stop said ejector piston means in said extended position.

24. A workpiece ejector system according to claim 23, wherein said outer end of said ejector piston means engages said abutment means before said slide means reaches said second position, and fluid pressure relief means in flow communication with said ejector chamber means and said fluid receiving chamber means to release fluid under pressure therein following engagement of said ejector piston means with said abutment means.

25. A workpiece ejector system according to claim 24, wherein said relief means is fluid pressure responsive accumulator means.

* * * * *

UNITED STATES PATENT AND TRADEMARK OFFICE

CERTIFICATE OF CORRECTION

PATENT NO. : 4,370,878

DATED : February 1, 1983

INVENTOR(S) : Louis F. Carrieri

It is certified that error appears in the above-identified patent and that said Letters Patent are hereby corrected as shown below:

Column 1, line 42, after "tooling" insert --with-- .

Claim 18, column 11, line 34, after "ejector" insert --chamber-- .

Signed and Sealed this

*Twentieth* Day of *September 1983*

[SEAL]

*Attest:*

GERALD J. MOSSINGHOFF

*Attesting Officer*

*Commissioner of Patents and Trademarks*